US005462183A

United States Patent [19]

Rohr et al.

[11] Patent Number: 5,462,183

[45] Date of Patent: Oct. 31, 1995

[54] CLOSURE WITH A TAMPER-EVIDENT ELEMENT

[75] Inventors: Robert D. Rohr, Eagle; John M. Hess, Waukesha; Richard J. Daniels, Caledonia, all of Wis.; John Elliott, Waukegan, Ill.

[73] Assignee: AptarGroup, Inc., Crystal Lake, Ill.

[21] Appl. No.: 353,129

[22] Filed: Dec. 9, 1994

Related U.S. Application Data

[63] Continuation-in-part of Ser. No. 193,273, Feb. 7, 1994, abandoned.

[51] Int. Cl.[6] ..... B65D 17/34

[52] U.S. Cl. ..... 215/237; 220/256; 220/214; 220/DIG. 34

[58] Field of Search ..... 220/338, 337, 220/235, 237, 316, 255, 256, 257, 258, 214, DIG. 34

[56] References Cited

U.S. PATENT DOCUMENTS

| | | |
|---|---|---|
| 3,117,703 | 1/1964 | Henchert . |
| 3,135,441 | 6/1964 | Wise et al. . |
| 3,239,112 | 3/1966 | Porcelli . |
| 3,255,915 | 6/1966 | Scholtz . |
| 3,255,928 | 7/1966 | Foster . |
| 3,278,089 | 10/1966 | Heekin et al. . |
| 3,282,477 | 11/1966 | Henchert . |
| 3,458,080 | 7/1969 | Laurizio . |
| 3,495,746 | 2/1970 | Laurizio . |
| 3,604,585 | 9/1971 | Towns . |
| 3,651,992 | 3/1972 | Hazard . |
| 3,708,083 | 1/1973 | Gronemeyer et al. . |
| 3,744,682 | 7/1973 | Blank . |
| 3,788,549 | 1/1974 | Ostrowsky . |
| 3,873,006 | 3/1975 | Fields . |
| 3,881,638 | 5/1975 | Grothoff . |
| 3,966,080 | 6/1976 | Bittel . |
| 4,047,643 | 9/1977 | Hazard . |
| 4,067,482 | 1/1978 | Vogel et al. . |
| 4,127,221 | 11/1978 | Vere . |
| 4,129,226 | 12/1978 | Jorgensen . |
| 4,170,315 | 10/1979 | Dubach et al. . |
| 4,344,545 | 8/1982 | Aschberger et al. . |
| 4,353,483 | 10/1982 | Pehr . |
| 4,361,244 | 11/1982 | Walter . |
| 4,361,250 | 11/1982 | Foster . |
| 4,371,088 | 2/1983 | Gach . |
| 4,378,073 | 3/1983 | Luker . |
| 4,397,400 | 8/1983 | Walter . |
| 4,407,423 | 10/1983 | Walter . |
| 4,431,110 | 2/1984 | Roth . |
| 4,460,100 | 7/1984 | Libit . |
| 4,462,504 | 7/1984 | Roth et al. . |
| 4,463,869 | 8/1984 | Lewis . |
| 4,467,931 | 8/1984 | Gach . |
| 4,487,324 | 12/1984 | Ostrowsky . |
| 4,519,517 | 5/1985 | Walter . |
| 4,592,480 | 6/1986 | Hart et al. . |
| 4,595,123 | 6/1986 | Libit . |
| 4,610,371 | 9/1986 | Karkiewicz . |

(List continued on next page.)

FOREIGN PATENT DOCUMENTS

| | | |
|---|---|---|
| 1333334 | 10/1973 | United Kingdom . |

*Primary Examiner*—Joseph Man-Fu Moy
*Attorney, Agent, or Firm*—Dressler, Goldsmith, Shore & Milnamow, Ltd.

[57] ABSTRACT

A tamper-evident closure is provided with a base having a deck with a discharge aperture. A lid is included for covering the discharge aperture on the base. The lid defines a latch aperture. The base has a resilient locking lever that projects from the base deck and through the lid latch aperture when the lid is closed. The lever engages the lid and holds the lid closed. A tamper-indicating element is provided on the lid to prevent operation of the lever. The element is attached to the lid with frangible portions which can be broken when sufficient force is applied to remove at least a part of the element and permit operation of the lever whereby another part of the element remains on the lid to provide evidence that part of the element has been removed.

19 Claims, 3 Drawing Sheets

U.S. PATENT DOCUMENTS 4,621,744 11/1986 Foster .
4,658,980 4/1987 Lindstrom .
4,682,702 7/1987 Gach .
4,696,408 9/1987 Dubach .
4,711,363 12/1987 Marino .
4,711,372 12/1987 Gach .
4,711,380 12/1987 Ulm .
4,733,787 3/1988 Knopf et al. .
4,736,858 4/1988 Shastal .
4,763,801 8/1988 Nyez .
4,775,065 10/1988 Shastal .
4,778,070 10/1988 Walker .
4,778,072 10/1988 Newman .
4,779,766 10/1988 Kinsley .
4,782,964 11/1988 Poore et al. .
4,795,044 1/1989 Beck .
4,796,769 1/1989 Obadia .
4,807,769 2/1989 Gach .
4,809,874 3/1989 Pehr ..... 220/338
4,869,399 9/1989 Dubach .
4,892,217 1/1990 Shastal .
4,901,892 2/1990 Song .
4,938,390 7/1990 Markva .
4,941,592 7/1990 Kitterman .
4,948,003 8/1990 Munoz .
4,969,574 11/1990 Shastal .
4,984,716 1/1991 Beck .
5,052,572 10/1991 Pherigo .
5,058,775 10/1991 Gross et al. .
5,069,367 12/1991 Salmon et al. .
5,094,361 3/1992 Dubach .
5,123,235 5/1993 Miranda .
5,123,561 6/1992 Gross .
5,147,054 9/1992 Pehr .
5,158,197 10/1992 Richter et al. .
5,197,618 3/1993 Goth .
5,199,618 4/1993 Reil et al. .
5,201,440 4/1993 Gross .
5,271,519 12/1993 Adams et al. .
5,356,017 10/1994 Rohr et al. .

FIG. 1
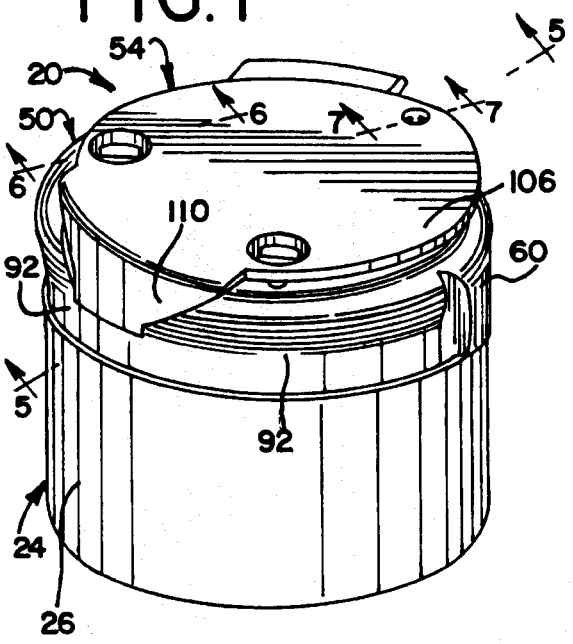
FIG. 2
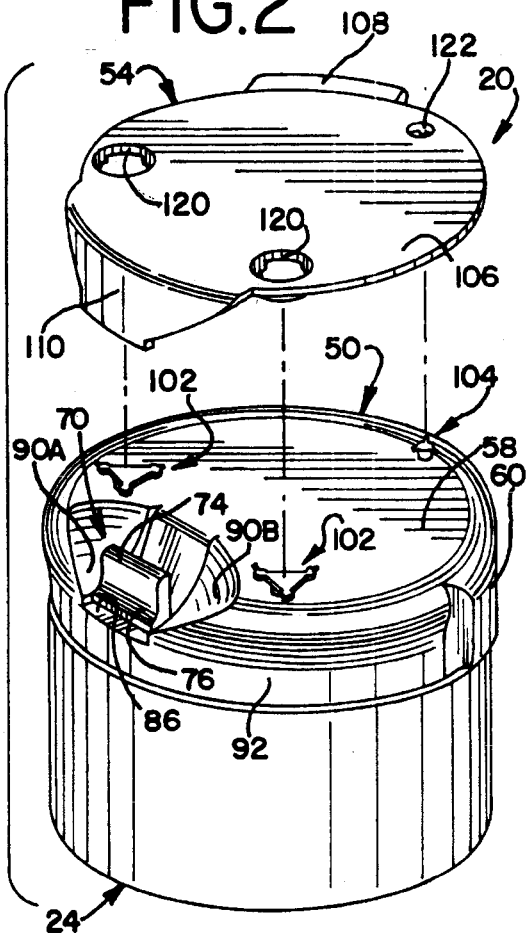
FIG. 3
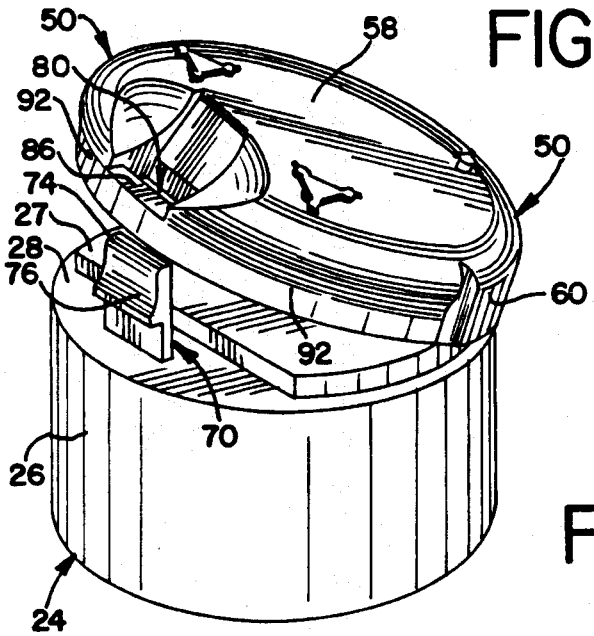
FIG. 4A
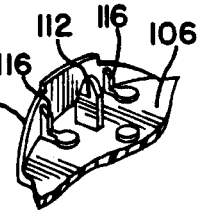
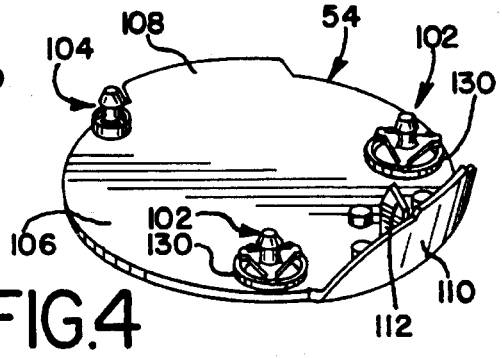
FIG. 4

FIG.10
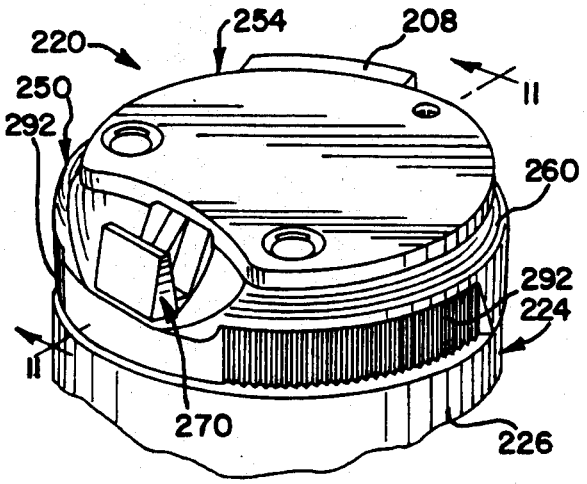
FIG.12
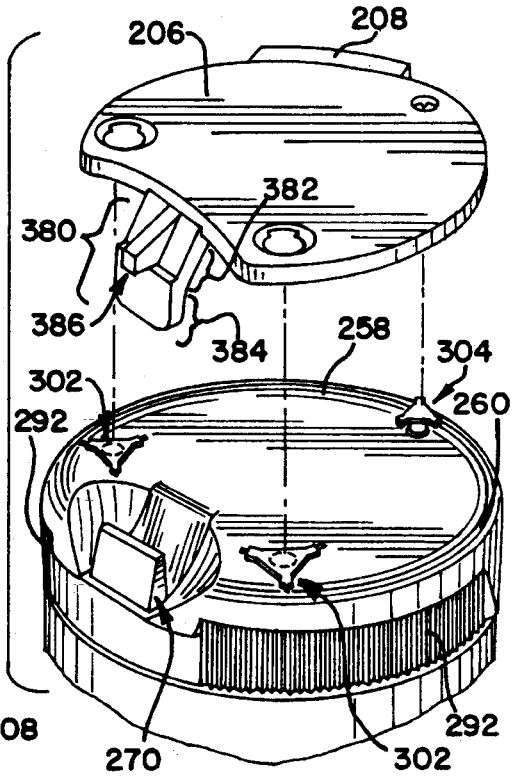
FIG.14
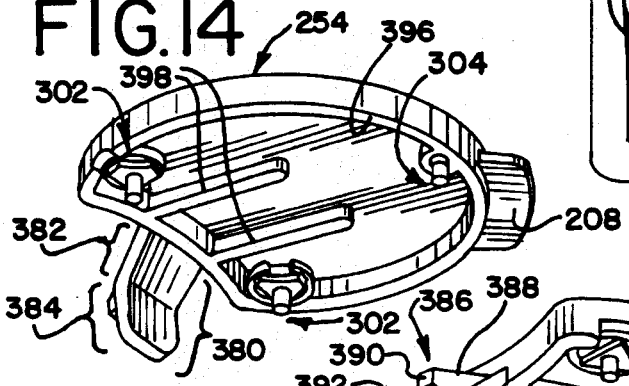
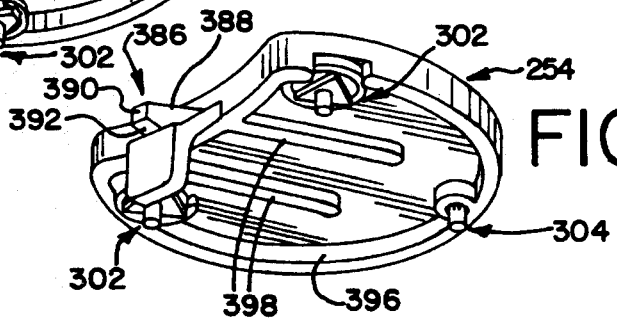
FIG.13
FIG.11
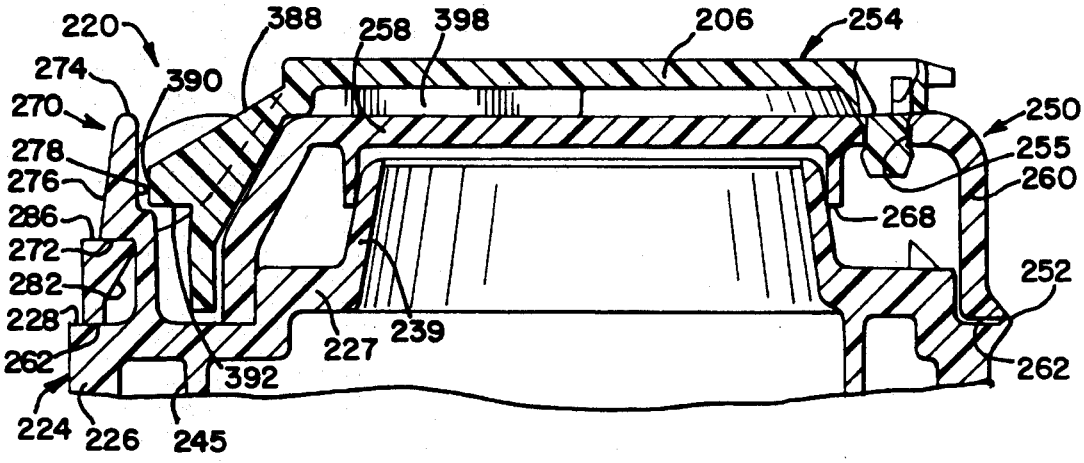

CLOSURE WITH A TAMPER-EVIDENT ELEMENT

CROSS REFERENCE TO RELATED APPLICATION

This is a continuation-in-part application of U.S. patent application Ser. No. 08/193,273, filed Feb. 7, 1994, now abandoned.

TECHNICAL FIELD

This invention relates to a tamper-evident closure for a container.

BACKGROUND OF THE INVENTION AND TECHNICAL PROBLEMS POSED BY THE PRIOR ART

Designs have been proposed for container closures which include a latch for holding the closure closed and preventing the opening of the closure unless the closure latch is manipulated in a specific manner. Some such designs are particularly suitable for use as child-resistant closures.

The U.S. Pat. No. 5,356,017 discloses a closure having a child-resistant latch. The closure has a base or body adapted to be mounted on the container over the opening and defines a discharge aperture through which the container contents can be dispensed. The latch includes a locking member in the form of a lever projecting upwardly from the closure body.

A lid is hingedly connected to the body for movement between a closed position occluding the discharge aperture in an open position spaced from the discharge aperture. The lid defines an aperture for receiving the lever when the lid is closed so that the lever engages an adjacent portion of the lid and holds the lid closed.

In order to open the closure, the lever must be pushed in one direction while the lid is lifted. This requires the use of some fingers of both hands, as well as some significant finger strength. Small children are not capable of performing the necessary manipulations with strength sufficient to open the closure.

While the above-discussed child-resistant closure functions well, it would be desirable to provide, in some applications, a tamper-evident feature on the closure. Preferably, such a tamper-evident feature should prevent operation of the latch unless the tamper-evident feature is removed. Further, the removal should result in a readily observable, altered configuration or appearance which will be immediately indicative of the removal of the tamper-evident feature or portion thereof.

It would also be desirable to provide an improved tamper-evident feature suitable for use with a variety of latched closure designs which could be relatively easily incorporated in such existing closure designs.

Further, it would be beneficial if such an improved tamper-evident design could be readily employed with various types of child-resistant closures as well as non-child-resistant closures.

It would also be advantageous if such an improved tamper-evident design could be readily fabricated from thermoplastic materials and include separate pieces of contrasting color.

It would also be beneficial if such an improved closure could be provided in a form that would not require excessively complicated manufacturing operations and that would permit the use of conventional, high-speed, automatic capping machines for applying the closure to a container.

The present invention can be embodied in designs that provide one or more of the above-discussed benefits and features.

SUMMARY OF THE INVENTION

The present invention provides a tamper-evident closure offering advantages of greater design flexibility, improved child resistance, easier manufacturing, and better compatibility with high-speed, automatic capping machines.

The closure includes a base or body for attachment to the container. In the preferred embodiment, the base includes a deck defining a discharge aperture communicating with the container.

The closure also includes a lid for movement between the closed position occluding the discharge aperture and an opened position spaced from the discharge aperture. In the preferred embodiment, the lid is hingedly connected to the body.

A releasable latch is defined cooperatively by the base and lid to hold the lid closed. In a preferred embodiment, the latch includes (1) a latch surface on the lid adjacent a receiving aperture defined in the lid, and (2) a lever unitary with, and projecting upwardly from, the base to project through the lid receiving aperture and engage the latch surface when the lid is closed.

A separate tamper-indicating element or plate, which is not molded as part of the lid, is mounted to the lid so as to prevent operation of the latch. The element includes (1) a removable part, and (2) an attachment structure that is engaged with the lid and that has a frangible portion which can be broken when sufficient force is applied to remove the removable part to permit operation of the latch.

At least a portion of the attachment structure remains on the lid to provide evidence that the tamper-indicating element has been removed.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a perspective view of a first embodiment of a closure of the present invention shown with a tamper-evident element in place;

FIG. 2 is a view similar to FIG. i showing a removable part of the element removed;

FIG. 3 is a view similar to FIG. 2 showing the lid opened part way;

FIG. 4 is a perspective view of the underside of the element prior to installation on a closure;

FIG. 4A is a fragmentary view of a portion of the element showing rigidifying ribs;

FIG. 10 is a fragmentary, perspective view of a second, preferred embodiment of a closure of the present invention shown with a tamper-evident element in place;

FIG. 11 is a greatly enlarged, cross-sectional view, taken generally along the plane 11—11 in FIG. 10;

FIG. 12 is a view similar to FIG. 10, but FIG. 2 shows a removable part of the element removed;

FIG. 13 is a perspective view of the underside of the element prior to installation on a closure; and FIG. 14 is a view similar to FIG. 13, but showing the element rotated about 90° .

DESCRIPTION OF THE PREFERRED EMBODIMENT

Figure 5:
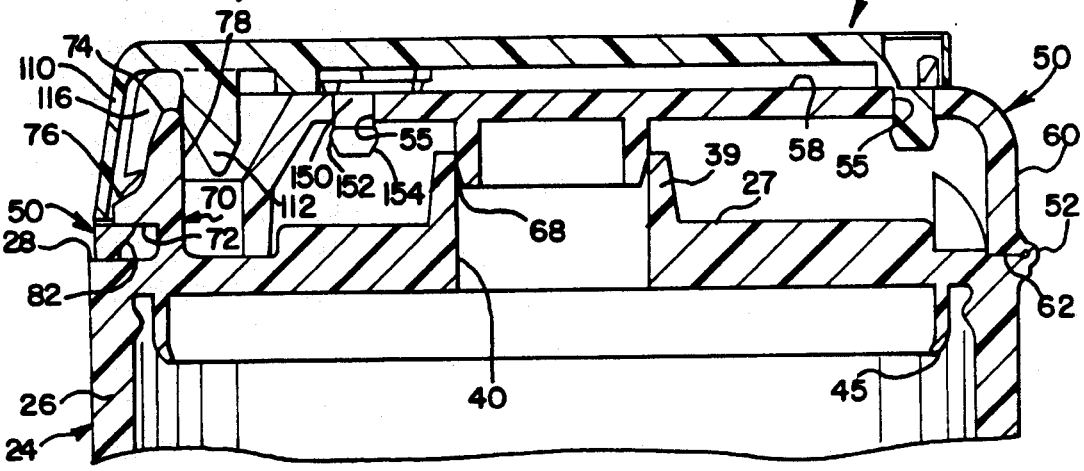
FIG. 5 is a greatly enlarged, cross-sectional view, taken generally along the plane 5—5 in FIG. 1.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

FIG. 1 shows a first embodiment of the tamper-evident closure of the present invention in a fully closed condition wherein the closure is represented generally by the reference numeral 20. The closure 20 is adapted to be mounted on a container (not illustrated) which may have a conventional open mouth defined by a neck (not illustrated) or other suitable structure.

The closure 20 includes a closure base or body 24 for securement to the container. The base 24 includes a generally cylindrical, peripheral wall 26 and a generally transverse closure wall or deck 28 (FIGS. 3 and 5) which extends across the base 24. A central portion 27 of the base deck 28 is thicker so that the surrounding portion of the deck 28 defines a peripheral shoulder.

The cylindrical wall 26 of the closure base 24 is adapted to engage the outer periphery of the top of the container neck (not illustrated) around the container mouth, as with threads (having an appropriate structure for preventing removal of the installed closure). Other suitable engaging means (e.g., snap-fit beads) may be provided to secure the closure base 24 on the container. Alternatively, in some applications the closure base 24 could be non-releasably attached to, or formed unitary with, the container.

The closure base 24 includes a discharge passage 40 through the deck 28 (FIG. 5). The closure passage 40 is surrounded by a hollow discharge tube 39. The tube 39 projects upwardly from the body deck 28.

A conventional sealing ring 45 projects downwardly from the underside of the deck 28 for engaging an interior edge of the container neck at the container mouth to effect a tight seal.

Preferably, a lid 50 is hingedly connected by a hinge means or hinge 52 (FIG. 5) to the edge of the base 24. The lid 50 carries a tamper-indicating element or member 54 which must be removed, as explained in detail hereinafter, to provide access to the lid for opening and closing the lid 50. The lid 50 defines three holes 55 (FIG. 5 shows two of the three holes 55), and each hole 55 is adapted to receive a portion of the element 54 to anchor the element 54 to the lid 50 as explained in detail hereinafter.

The lid 50 is adapted to be pivoted between (1) a closed position (FIG. 1) preventing flow of the container-stored contents through the closure and (2) an open position moved away from the closed position to permit the dispensing of the container-stored contents from the base discharge aperture (FIG. 3 shows a partly open position).

In the embodiment illustrated in FIGS. 1–9, the hinge 52 is a snap-action hinge of the conventional type described in the U.S. Pat. No. 4,403,712. If a hinge is employed, it is not required that the hinge 52 be a snap-action type hinge. Any suitable hinge system may be employed for connecting the lid 50 to the base 24 consistent with the particular application requirements, aesthetics, manufacturing techniques, etc.

Preferably the lid 50 and the closure body 24 are molded as a unitary structure from suitable thermoplastic materials, such as polypropylene or polyethylene. However, the lid 50 and body 24 could be formed as separate pieces, and preferably would in such a case be designed for subsequent assembly with a suitable connecting hinge system to permit opening and closing of the lid. The detailed design and operation of the hinge per se form no part of the present invention.

The lid 50 preferably includes a central cover panel 58 and has a peripheral skirt 60 depending from the periphery of the central cover panel 58. The lid skirt 60 has a bottom surface 62 (FIG. 5) defining a bottom surface of the lid. The skirt bottom surface 62 is adapted to rest on the peripheral, annular shoulder of the base deck 28 when the lid is closed as illustrated in FIG. 5.

In the embodiment illustrated in FIGS. 1–9, the lid 50 also includes a sealing spud or member 68 (FIG. 5) which projects from the central cover panel 58. The sealing member 68 is adapted to enter into the discharge opening of the hollow tube 39 projecting upwardly from the base central deck region 27 when the lid 50 is closed (FIG. 5). This is particularly suitable for use with containers of liquids.

It will be appreciated, however, that the base discharge tube 39 and lid sealing member 68 need not be provided in the form illustrated, or need not be provided at all. If the closure 20 is used with liquids, then other means for sealing the closure lid 50 and base 24, as around the lid skirt bottom surface 62, may be employed. If the closure 20 is designed for a container for pills or other individual items, then a major portion of the base deck central portion 27 may be eliminated in order to provide a relatively large access opening to the container. In such a case, the discharge tube 39 and lid sealing member 68 would, of course, be eliminated.

A novel latching mechanism is provided for maintaining the lid 50 in the closed position and inhibiting a child from opening the closure—even after the element 54 is removed (as explained in detail hereinafter). Specifically, at the front of the closure 20, diametrically opposite from the hinge 52, the base 24 has a resilient locking lever 70 (FIGS. 1–3 and 5) which projects upwardly from the base deck 28 at a location inwardly of the periphery of the base. The locking lever 70 has an outwardly extending, and downwardly facing, shoulder 72 (FIG. 5). The lever 70 is relative stiff, and a small child would find it difficult, if not impossible, to use a finger to bend or deflect the locking lever 70 rearwardly toward the hinge 52.

The top of the locking member 70 has a curved distal end 74, and the front region of the locking member 70 above the shoulder 72 extends outwardly, in a slightly convex curve, from the thinner distal end to the outer edge of the shoulder 72. This defines a camming surface 76 against which the lid 50 acts as explained hereinafter. The lever 70 also has an upper rear surface 78 (FIG. 5).

The lid central cover panel 58 defines an aperture 80 (FIG. 3) inwardly of the periphery of the lid for receiving the lever 70 when the lid is closed (FIG. 5). The bottom of the aperture 80 opens at the bottom surface of the lid (i.e., lid skirt bottom surface 62).

The front of the aperture 80 is defined by an inwardly slanting, planar, upper front wall 82. The wall 82 acts as a cam surface for engaging the lever camming surface 76 as the lid 50 is pivoted downwardly to the fully closed position. As the cam wall 82 and lever surface 76 engage, the lever 70 is deflected rearwardly, to accommodate movement of the lid 50 to the fully closed position wherein the lid skirt seating surface 62 engages the base deck 28.

The upper edge of the lid cam wall 82 terminates at a horizontally disposed latch surface 86 (FIG. 3) at an elevation slightly below the elevation of the downwardly facing shoulder 72 on the lever 70. Thus, when the lid 50 is fully seated in the closed position, the lever 70 returns to its normal, undeflected position owing to the inherent resiliency of the lever material. When the locking lever 70 has returned to the normal, unstressed position illustrated in FIG. 5, the locking lever shoulder 72 overlies the lid latch surface 86 and prevents the lid 50 from being pivoted upwardly unless the locking lever 70 is first pivoted rearwardly.

When the lid 50 is fully closed as illustrated in FIG. 5, the top surface of the lid on either lateral side of the lever 70 is at an elevation slightly greater than the top of the lever distal end 74. The clearance around the top of the lever 70, and the overall width of the lever 70, are relatively small. This reduces the exposure of the lever 70 to engagement with a child's teeth and inhibits efforts of a child to bend the lever 70 rearwardly. Further, the small clearance around the lever 70 inhibits the insertion of a child's teeth under the lever shoulder 72.

Figure 6:
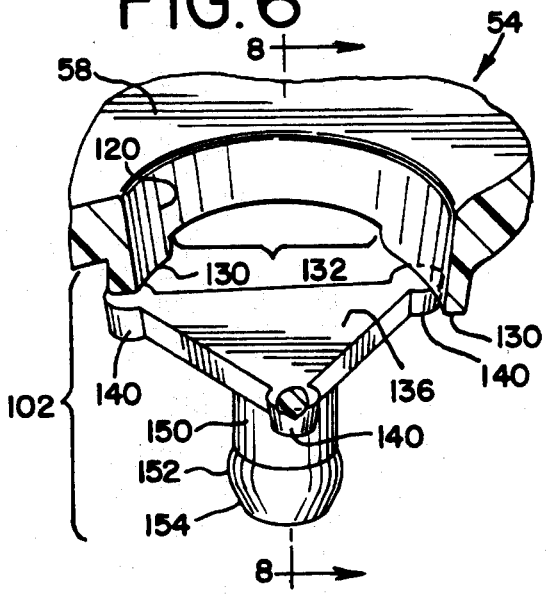
FIG. 6 is a greatly enlarged, fragmentary, perspective view partly in cross-section taken generally along the plane 6—6 in FIG. 1.

However, in order to facilitate opening of the closure by an adult user, the lid 50 defines a finger access recess around, and extending from the aperture, and the recess is defined in part by two, spaced-apart, concave, curved surfaces 90A and 90B (FIG. 6). The surfaces 90A and 90B accommodate the width of a typical adult finger so that an adult can position a finger adjacent the upper front portion of the locking lever 70 and push the locking lever 70 rearwardly. However, the overall extent of the depth and width of the adjacent surfaces 90A and 90B are relatively small so as to reduce the exposure of the lever 70 to engagement with a child's teeth and so as to inhibit efforts of a child to bend the lever 70 rearwardly.

Further, as illustrated in FIG. 2, the top of the locking lever distal end 74 is preferably recessed slightly below the top of the adjacent central cover panel 58 of the lid. Further, as can be seen in FIG. 5, the peripheral region of the lid 50, including the skirt 60, extends outwardly beyond the front of the locking lever 70 to prevent a child's teeth from engaging the front of the lever 70.

To assist an adult user in opening the closure, the lid 50 includes a pair of finger-engaging surfaces 92 (FIGS. 1 and 3) with one surface 92 on one side of the latch area and with one surface 92 on the other side of the latch area. Each finger-engaging surface 92 is defined in the skirt lid 60 by a shallow indentation. The indentations 92 extend part way around the lid on either side of the lid aperture 80. Each finger-engaging surface 92 forms an outwardly facing, smooth wall defining a rear portion of the indentation.

Preferably, each indentation and associated finger-engaging surface 92 extends completely to the skirt bottom surface 62 but terminates short of the top of the skirt. Further, the end of each finger-engaging surface 92 near the aperture 80 merges with the lid skirt 60.

In order to permit the adult user's finger to exert an upper, opening force on the lid 50, each finger-engaging surface 92 extends progressively outwardly with increasing distance from the lid bottom surface 62 as can be seen in FIG. 6. The finger-engaging surface 92 terminates along a top edge which extends forwardly or outwardly of the lid skirt bottom edge. However, but the finger-engaging surface 92 is free of overhanging peripheral surfaces of a depth sufficient to be liftingly engaged by a child's teeth. That is, the indentation is sufficiently shallow and slopped or curved so that the child's upper or lower front teeth cannot effectively engage, in a non-slipping manner, the surface 92 and apply sufficient force in the direction needed to pry the lid 50 away from the base 24.

Further, the other portions of the lip periphery between the two finger-engaging surfaces 92 and between each surface 92 and the hinge 52 are free of overhanging peripheral surfaces of sufficient depth to be liftingly engaged by a child's teeth.

In order to increase the child resistance of the closure 20, the finger-engaging recesses 92 do not extend in front of the region of the locking lever 70. That is, the lift area presented by each finger-engaging surface 92 is laterally displaced from the locking lever 70 and aperture 80 by an amount sufficient to require the user to perform the opening manipulations at two distinctly different locations on the closure in order to open the lid. Thus, the locking lever 70 must be engaged at one location on the lid 50, and while the locking lever is deflected, the lid 50 must be opened by lifting at one or both of the separated, laterally displaced, finger-engaging surfaces 92. This manipulation sequence is difficult and confusing for small children.

Preferably, the surface of skirt 60 immediately below the latch surface 86 (FIG. 2) between the finger-engaging surfaces 92 is substantially vertical and smooth, and is somewhat forward of the locking lever shoulder 72 (FIG. 5), so as to eliminate or reduce the presence of surfaces or edges that could be engaged by a child's teeth to separate or distort the structures in the region of the locking lever 70.

In addition, the portion of the base 24 that extends from the hinge 52 is configured to project peripherally outwardly at least as far as the lid bottom surface 62. Preferably, the front portion of the base 24 extends peripherally outwardly further than the lid skirt bottom surface 62 as illustrated in FIGS. 1 and 5. Because the front portion of the base 24 normally projects beyond the closed lid 50, the closure has a larger range of manufacturing (molding) tolerances. That is, the molding of a slightly larger lid would still not result in the front portion of the lid projecting peripherally beyond the base 24 so as to create an overhanging ledge that could be engaged by a child's teeth. Thus, the closure has the capability for more easily accommodating manufacturing processes.

The closure of the present invention provides improved child resistance. Because the preferred embodiment of the closure has an inset latch structure and a lid free of overhanging peripheral surfaces with a depth sufficient to be engaged by a child's teeth, the lid is highly resistant to being pried open by a child's teeth. The smooth contours of the lid in the finger lift areas and in the locking lever area eliminate sharp edges and ledges so as to prevent a child's teeth from effectively engaging the closure in a manner that could deform and distort the closure to permit opening.

Further, the recess area around the locking lever is configured so that if a child bites down on the top, front portion of the lid 50, then the child's teeth will only force the closure lid more tightly against the closure base. The front surface of the locking lever 70, with its smooth, curved contour, resists being effectively engaged by a child's teeth. On the other hand, engagement of the rear surface of the locking lever by some means, as with some external instrument inserted between the lever and lid, will serve only to push the locking lever further forwardly into a greater engagement with the lid.

The tamper-indicating element 54 is mounted to the top of the lid 50 as illustrated in FIG. 1 to prevent operation of the latch by preventing access to the lever 70. The tamper-indicating element 54 includes a removable part which must be torn away from the top of the lid 50 to expose the lever 70. When the tamper-indicating element 54 is torn away, as illustrated in FIG. 2, two front anchor portions 102 and one rear anchor portion 104 remain on the lid deck 58. These provide an indication that part of the tamper-indicating element 54 has been removed. This tells the user that the closure 20 is, and has been, in condition for opening, and therefore, that the closure may indeed have been opened. Thus, the anchor portions 102 and 104 retained on the closure lid 50 function as tamper-evident indicia and are evidence that the integrity of the closure can no longer be guaranteed.

The tamper-indicating element 54 includes a central, flat, disc-like portion or plate 106 having a rear lift tab 108 and a downwardly depending, front latch guard or shroud 110. As illustrated in FIG. 1, the latch guard 110 extends over the latch or lever 70 to prevent access thereto. As illustrated in FIG. 4, the underside of the element 54 also preferably includes a downwardly projecting rib 112 spaced slightly inwardly of the latch guard 110. The rib 112 is adapted to extend downwardly behind the lever 70 to prevent rearward movement of the lever 70 until the element 54 is removed.

The underside of the element 54 also includes two additional, spaced-apart, parallel ribs 116 (one of which is visible in FIG. 5) along the inside surface of the guard 110. These ribs transfer the bending moment from the guard 110 to the flat, disc-like portion 106 of the element 54 when an attempt is made to lift the guard 110 to expose the lever 70 in the latch area. The inner edge of each rib 116 fits in front of, and may contact, the front surface of the lever 70.

The plate 106, including the lift tab 108, latch guard 110, rib 112, and ribs 116, constitute a substantial portion of the removable part of the tamper-indicating element 54. The removable part of the element 54 is connected to the lid 50 with an attachment structure as will next be described.

Figure 7:
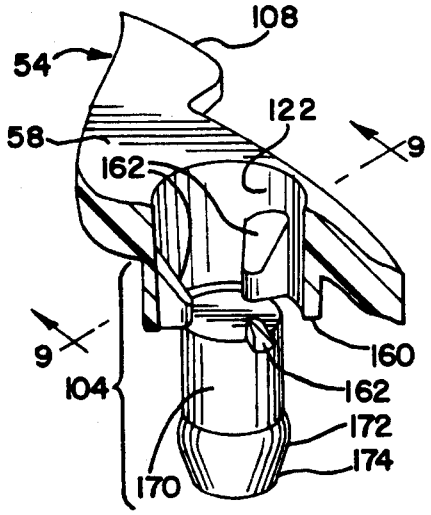
FIG. 7 is a greatly enlarged, fragmentary, perspective view taken partly in cross-section generally along the plane 7—7 in FIG. 1.

As can be seen in FIG. 2, the front portion of the element 54 has two holes 120, and the rear portion of the element 54 has one hole 122. As can be seen in FIGS. 6 and 7, each front anchor portion 102 is connected to the cover at the periphery of a hole 120, and the rear anchor portion 104 is connected to the element 54 at the periphery of the hole 122.

As illustrated in FIG. 4, adjacent each front anchor portion 102 the plate 106 defines a partially cylindrical section or flange 130. Each flange 130 defines an arc of about 300 degrees. This leaves about a 60 degree notch 132 (FIG. 6). Each flange 130 reinforces the region around the hole 120.

Figure 8:
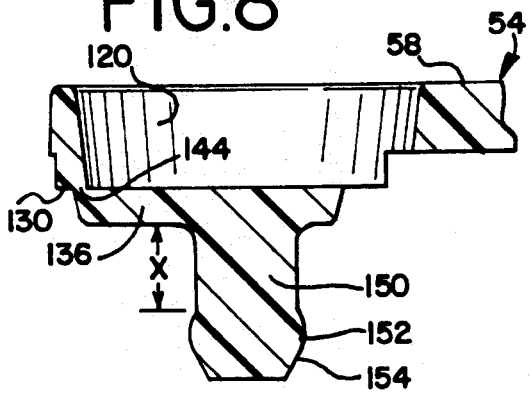
FIG. 8 is a fragmentary, cross-sectional view taken generally along the plane 8—8 in FIG. 6.

A generally triangle-shaped, load-bearing plate 136 (FIGS. 6 and 8) is connected to the bottom edge of the partially cylindrical flange 130. In the preferred embodiment, the element 54 is molded from thermoplastic material (e.g., polypropylene) as a unitary structure. The triangle-shaped plate 136 is thus attached to the circular plate 106 as a unitary extension of the semi-cylindrical flange 130. The triangle-shaped plate 136 is connected to the flange 130 at each of the three corners of the triangular shape. Each corner of the plate 136 includes a partially cylindrical portion 140 (FIG. 6) which is directly adjacent to, and is connected with, the flange 130. The connection between the flange 130 and each semi-cylindrical portion 140 of the triangle-shaped plate 136 is relatively thin and defines a frangible connection 144 (FIG. 8).

Projecting downwardly from the underside of the triangle-shaped plate 136 is an anchor post 150. The anchor post 150 has an enlarged diameter head 152 with a frustoconical, tapered distal end 154. Each post 150 is adapted to be received in one of the two lid holes 55 (one of which holes 55 is illustrated in FIG. 5). Each post 150 is concentric with the element hole 120. When the element 54 is installed on the closure lid 50, each post 150 is also concentric with the receiving hole 55 in the lid.

The distance x (FIG. 8) from the underside of the plate 136 to the top of the post enlarged end 152 is equal to or greater than the thickness of the lid central portion 58. Preferably, the diameter of the shaft of the post 150 (inwardly of (above) the enlarged head 152) is slightly larger than the diameter of the lid hole 55. The enlarged head 152 is also necessarily larger than the diameter of the hole 55. The tapered, frustoconical distal end 154 of the post 150 accommodates insertion of the post 150 into the hole 55 in the lid 50. The lower distal end of the tapered end 154 of the post has a diameter less than the diameter of the lid receiving hole 55 to accommodate insertion. During insertion, the hole 55 is temporarily deformed (enlarged) to accommodate the insertion of the larger head 152. The hole 55 remains slightly enlarged to accommodate the slightly larger diameter shank of the post 150.

The frangible connections 144 between the triangle-shaped plate 136 and the flange 130 are strong enough to accommodate the compressive forces generated during insertion of the shroud posts 150 where the closure is assembled. However, each frangible connection portion 144 will break when sufficient tensile and/or bending forces are applied to the element 54 as the plate 106 is lifted upwardly (by grasping the tab 108 (FIG. 2 and FIG. 7)). The plate 106 breaks from the plate 136 at the frangible portions 144 so that the front anchor portions 102 (FIGS. 4 and 6) remain in the lid 50. The anchor portions 102 are prevented from being pulled out of the lid 50 owing to the enlarged heads 152 on the posts 150.

When the frangible portions 144 are fractured, the remaining anchor portions 102 retained on the lid 50 are substantially free of any sharp protrusions that may be unsightly or hazardous.

If desired, each post 150 may project upwardly from the upper side of the triangle-shaped plate 136 to provide a protrusion that is more visible than is just the flat surface of the triangle-shaped plate 136. In this alternate embodiment, which is not illustrated, the upwardly projecting portion of the post 150 would preferably have a height less than or equal to the height of the top surface of the element 54.

The rear anchor portion 104 may have the same structure as the front anchor portion described above with reference to FIGS. 6 and 8. However, in the embodiment of the rear anchor portion illustrated in FIGS. 7 and 9, the rear anchor portion 104 has a different structure which eliminates the triangle-shaped plate 136 employed in the front anchor portion 102. Adjacent the rear anchor portion 104, the plate 106 defines a cylindrical flange 160 which projects downwardly from the underside of the element 54 to define a continuation of the hole 122.

Three ribs 162 extend radially inwardly from the internal diameter of the hole 122. Each rib 162 has an angled top surface 164 (FIG. 9) and a downwardly facing bottom surface 166.

The bottom surface 166 of each rib 162 merges at a frangible connection 168 with the top of a post 170. The ribs 162 and frangible connection 168 are sufficient in size to provide adequate filling for the molding process and to provide a suitable fracture strength which accommodates assembly of the element 54 on the closure.

The post 170 has an enlarged end head 172 with a frustoconical or tapered or distal end surface 174. The diameter at the lower end of the tapered surface 174 is less than the diameter of the closure lid receiving hole 55, but the diameter of the head 172 is greater than the diameter of the closure lid hole 55. Preferably, the diameter of the shank of the post 170 inwardly of (above) the head 172 is also slightly larger than the diameter of the lid hole 55. The post 170 can be inserted into the hole 55, and some deformation necessarily occurs. However, the resiliency of the lid material causes the size of the hole 55 to reduce to a diameter smaller than the head 172 for tightly retaining the post 170 in the closure lid 50.

Figure 9:
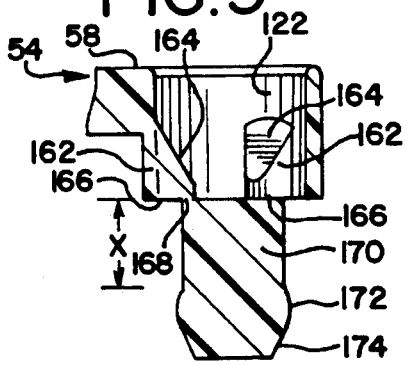
FIG. 9 is a fragmentary, cross-sectional view taken generally along the plane 9—9 in FIG. 7.

With reference with FIGS. 7 and 9, it will be appreciated that each frangible connection 168 is located at the outermost portion of the post 170. Preferably, the post 170 is concentric with the hole 122, and the diameter of the shank of the post 170 is slightly less than the diameter of the hole 122.

The three frangible portions 168 connecting the post 170 to the ribs 162 are sufficiently small to be fractured when the plate 106 is lifted upwardly with sufficient force. The post 170 and broken connections to the ribs 162 define the rear anchor portion 104 (FIG. 2) which remains in the lid (as illustrated in FIG. 2) to provide evidence of tampering in the same manner as the front portions 102.

The portion of the element 54 above the frangible portions 168 (above the rear post 170) and above the frangible portions 136 (above the front posts 150) constitutes the removable part of the element and functions, when in place, as a shroud for preventing access to the latch lever 70. The removable part or shroud is removed by lifting up on the tab 108. The removable part can be discarded. The latch lever 70 is then exposed for operation to release the lid 50.

The anchor portions 102 and 104, along with the associated frangible portions 144 and 168, respectively, may be defined as the attachment structure for attaching the tamper-indicating element to the closure lid 50. Upon rupture of the frangible portions 144 and 168, the removable part of the element is lifted away, and the remaining part of the attachment structure on the lid includes only the anchor portions 102 and 104.

A second, and presently preferred, embodiment of the tamper-indicating closure of the present invention is illustrated in FIGS. 10–14. The closure is designated generally by the reference number 220 in FIGS. 10 and 11. The closure 220 is adapted to be mounted on a container (not illustrated) which may have a conventional open mouth defined by a neck (not illustrated) or other suitable structure.

The closure 220 includes a closure base or body 224 for securement to the container. The base 224 includes a generally cylindrical, peripheral wall 226, and a generally transverse closure deck 228 (FIG. 11) which extends across the base 224. A central portion 227 of the base deck 228 extends upwardly to form a stepped, elevated platform surrounded by a generally peripheral, lower portion of the deck 228.

The cylindrical wall 226 of the closure base 224 is adapted to engage the outer periphery of the top of the container neck (not illustrated) around the container mouth, as with threads (having an appropriate structure for preventing removal of the installed closure). Other suitable engaging means (e.g., snap-fit beads) may be provided to secure the closure base 224 on the container. Alternatively, in some applications, the closure base 224 could be non-releasably attached to, or formed unitary with, the container.

A conventional sealing ring 245 projects downwardly from the underside of the deck 228 for engaging an interior edge of the container neck at the container mouth to effect a tight seal.

The closure base 224 includes a discharge passage 240 through the deck central portion 227 (FIG. 11). The closure passage 240 is surrounded by a hollow discharge tube 239.

Preferably, a lid 250 is hingedly connected by a hinge means or hinge 252 to the edge of the base 224. The lid 250 carries a tamper-indicating element, plate, or member 254 which must be removed, as explained in detail hereinafter, to permit opening and closing of the lid 250.

As with the first embodiment of the lid 50 described above with reference to FIGS. 1–9, the second embodiment of the lid 250 defines three bases or holes (only one of which holes 255 is visible in FIG. 11). Each hole 255 is adapted for receiving a portion of the element 254 to anchor the element 254 to the lid 250 as explained in detail hereinafter.

As with the first embodiment of the lid 50 described above, the lid 250 is adapted to be pivoted between (1) a closed position (FIGS. 10, 11, and 12) and (2) an open position (not illustrated) moved away from the closed position to permit the dispensing of the container-stored contents from the base discharge aperture 240.

The hinge 252 may be of any suitable type, including the snap-action type hinge 52 described above with respect to the first embodiment illustrated in FIGS. 1–9. In the preferred embodiment, the lid 250 and closure body 224 are molded as a unitary structure from suitable thermoplastic materials, such as polypropylene or polyethylene. However, the lid 250 and body 224 could be formed as separate pieces, and preferably would in such a case be designed for subsequent assembly with a suitable connecting hinge system to permit opening and closing of the lid. The detailed design and operation of the hinge per se form no part of the present invention.

The lid 250 preferably includes a central cover panel 258 (FIGS. 11 and 12) and has a peripheral skirt 260 depending from the periphery of the central cover panel 258. The lid skirt 260 has a bottom surface 262 (FIG. 11) defining a bottom surface of the lid. The skirt bottom surface 262 is adapted to rest on the peripheral, annular surface of the base deck 228 when the lid 250 is closed as illustrated in FIG. 11.

The lid 250 also includes a sealing collar 268 (FIG. 11) which projects downwardly from the central cover panel 258. The sealing collar 268 is adapted to surround, and sealingly engage, the peripheral surface of the closure base discharge passage tube 239 (FIG. 11). This is particularly suitable for use with containers of liquids.

The base discharge tube 239 and lid sealing collar 268 need not be provided in the form illustrated, or need not be provided at all. Indeed, if the closure 220 is intended for use with substances other than liquids, such as small, solid items, then a liquid-tight seal might not be required in some applications.

As with the first embodiment of the closure discussed above with reference to FIGS. 1–9, the second embodiment illustrated in FIGS. 10–14 includes a latching mechanism for maintaining the lid 250 in the closed position and inhibiting a child from opening the closure—even after the tamper-indicating element 254 is removed (as explained in detail hereinafter). The latching system employed in the closure 220 is substantially the same as that employed in the first embodiment of the closure 20.

In particular, at the front of the closure 220, diametrically opposite the hinge 252, the base 224 has a resilient locking lever 270 (FIGS. 10, 11, and 12) which projects upwardly from the base deck 228 at a location inwardly of the periphery of the base. The locking lever 270 has an outwardly extending, and downwardly facing, shoulder 272. The lever 270 has a rear surface 278. The top of the lever 270 defines a curved, distal end 274. The lever 270 has an angled, front, camming surface 276 extending downwardly from the upper, distal end 274 to the shoulder 272.

The lid central cover panel 258 has an aperture defined in part by an inwardly slanting, planar, upper front wall 282. The wall 282 acts as a cam surface for engaging the lever camming surface 276 as the lid 250 is pivoted downwardly to the fully closed position. As the cam wall 282 and lever surface 276 engage, the lever 270 is deflected rearwardly, to accommodate movement of the lid 50 to the fully closed position wherein the lid skirt seating surface 262 engages the base deck 228.

The upper edge of the lid cam wall 282 terminates at a horizontally disposed latch surface 286 (FIG. 11). When the lid 250 is fully seated in the closed position, the lever 270 returns to its normal, undeflected position owing to the inherent resiliency of the lever material. When the locking lever 270 has returned to the normal, unstressed position illustrated in FIG. 11, the locking lever shoulder 272 overlies the lid latch surface 286 and prevents the lid 250 from being pivoted upwardly unless the locking lever 270 is first pivoted rearwardly.

Preferably, the lid defines a finger access recess around the lever 270 to facilitate opening of the closure by an adult user. This can include a recess having substantially the same shape as the recess in the closure lid 50 of the first embodiment illustrated in FIGS. 1–9 wherein the recess is defined in part by two curved surfaces 90A and 90B (FIG. 6). Also, the shape of the peripheral region at the front of the lid skirt may include finger-engaging surfaces or indentations 292 (FIG. 10) to facilitate the lifting of the lid 250.

The shape, configuration, and orientation of the surfaces of the lid 250 and lever 270 may be substantially similar to the shape, configuration, and orientation of the surfaces of the corresponding portions of the first embodiment of the closure 20 discussed above in detail with reference to FIGS. 1–9. However, a variety of surface configurations may be employed. Indeed, child-resistant shapes need not be employed with the present invention tamper-indicating element closure if child resistance is not required.

In order to prevent initial operation of the lever 270, the tamper-indicating element 254 is mounted to the lid 250. A portion of the element 254 must be torn away to permit operation of the lever 270. The element 254 includes a plate 206 which is mounted to the lid 250 with two front anchor portions 302 (FIG. 14) and one rear anchor portion 304 (FIG. 14). These anchor portions remain on the lid deck 258 after the removable portion of the element 254 is removed. The anchor portions 302 and 304 are received in the lid holes 255. The structure of the anchor portions 302 and 304 is identical with the structure of the first embodiment anchor portions 102 and 104 described above in detail with reference to FIGS. 1–9.

The anchor portions 302 and 304 are connected to the plate 206 with frangible connections having a structure that may be identical with the corresponding connections of the anchor portions 102 and 104 in the first embodiment of the tamper-indicating element 54 described above in detail. Further, the manner in which the anchor portions 302 and 304 are retained within the lid holes 255 may be the same as the manner in which the first embodiment anchor portions 102 and 104 are retained within the lid holes 55 as discussed above in detail with reference to FIGS. 1–9.

The tamper-indicating element plate 206 has a lift tab 208 (FIGS. 12 and 14) at a rear area of the plate 206. The element 254 can be pulled away from the lid 250 by pulling sufficiently hard on the lift tab 208. The plate 206 breaks away above the anchor portions 302 and 304 which remain in the lid 250.

The front of the plate 206 differs from the front of the first embodiment plate 106 described above in that the front of the plate 206 does not have a latch guard (such as the first embodiment latch guard 110 illustrated in FIGS. 1 and 2). Rather, the second embodiment plate 206 includes a downwardly angled tang or tab 380 (FIGS. 12 and 14).

As illustrated in FIG. 14, the tab 380 has a first, slanted portion 382 and a second, generally vertical portion 384. Also, as can be seen in FIG. 12, a rib 386 projects outwardly from the first, slanted portion 382. As can be seen in FIG. 11, the rib 386 has a downwardly angled top surface 388 and a generally vertically oriented surface 390 which terminates in a generally horizontally disposed, downwardly facing, bottom surface 392.

The tang or tab 380 and rib 386 are located at the rear surface of the locking lever 270 to inhibit substantial rearward movement of the locking lever 270 and to thus prevent opening of the lid 250. To this end, the tang 380 extends down into the lid aperture behind the locking lever 270 when the lid is in the closed position and the tamper-indicating element 254 is properly assembled on the lid 250. The rib 386 provides structural support and rigidity for the tab 380.

The tang 380 has a shape which accommodates insertion of the tang 380 behind the locking lever 270. Preferably, the transition from the top of the tamper-indicating element plate 206 to the tang 380 is relatively smooth and inhibits prying actions that might be effected by an individual attempting to dislodge the tang 380 from its position behind the locking tab 270.

The width of the tang 380 is generally less than the width of the locking lever 270. Some small amount of clearance is preferably provided so as to permit the tamper-indicating element 254 to freely fall away from the lid when the frangible attachment regions are broken as the tamper-indicating element lift tab 208 is lifted.

The tang 380 and rib 386 occupy substantially the entire free space behind the locking lever 70 so as to inhibit movement of the tang in an attempt to dislodge the tang from its position. Further, any substantial rearward (radially inward) movement of the locking lever 270 is inhibited by the rib 386. Preferably, however, a minimum amount of space is provided between the locking lever 270 and the tang 380. Although surface-to-surface contact is preferably established between the adjacent portion of the lid 250 and the rear surface of the tang 380, there is preferably a small amount of clearance between the rear surface of the locking lever 270 and the rib front surface 390 so as to prevent friction forces from holding the rib 386 in position when plate 206 is broken away from the anchor portions 302 and 304. Thus, if the tamper-indicating element 254 is broken at the anchor portions 302 and 304 and removed, attempts to recreate the originally assembled condition will not be successful. Specifically, if the removed element 254 is repositioned in its original location, the clearance between the front of the rib 386 and the rear surface of the locking lever 270 will prevent the establishment of a frictional engagement. Thus, the broken element 254 will readily shift out of position when subjected to the slightest movement. This will provide a clear indication that the element 254 has previously been removed.

It will be appreciated that, if desired, the tang 380 may be incorporated with a latch guard or shroud 110 as employed in the first embodiment of the closure illustrated in FIGS. 1–9.

The tamper-indicating plate 206 also preferably includes a peripheral flange 396 and a pair of spaced-apart, parallel ribs 398. The structures rigidify the tamper-indicating element.

Because the element 54 (FIG. 4) or 254 (FIG. 14) can be molded as a piece separate from the closure lid and body, the element can be molded from a material that is different than the material employed for the closure lid and body. This permits the use of materials that may be better suited to forming frangible connections or that may provide contrasting colors and/or textures.

The illustrated embodiments of the closure of the present invention accommodate product flexibility. Only one lid and body unit need be manufactured with the element post receiving holes (e.g., holes 55 in FIG. 5). In those applications where a tamper-evident element is not needed or desired, the closure lid and body may be used without the element installed. If the receiving holes would not be acceptable in such non-tamper-evident closure, a relatively simple modification of the mold parts would permit the lid to be molded without the holes. An adjustable mold assembly, which could accommodate molding the lid with or without the element-receiving holes, would thus provide manufacturing flexibility at a reduced cost.

It will be appreciated that other modifications may be made to the closure body, lid, and tamper-indicating element. For example, the locking lever (e.g., 70 in FIG. 3) may be replaced with some other suitable latching structure, operation of which would be effectively prevented by the tamper-indicating element (e.g., 54 in FIGS. 1 and 2). Further, the element 54 or 254 may have a shape other than the shapes disclosed in the figures. Also, the element 54 or 254 may be anchored to the lid with less than three anchor portions or more than three anchor portions. Further, the structure of the anchor portions may be changed from that shown in the figures.

It will be readily apparent from the foregoing detailed description of the invention and from the illustrations thereof that numerous variations and modifications may be effected without departing from the true spirit and scope of the novel concepts or principles of this invention.

What is claimed is:

1. A tamper-evident closure for an opening to a container interior, said closure comprising:

a molded unitary structure including (1) a base for attachment to said container, said base defining a discharge aperture, (2) a lid for movement between a closed position occluding said discharge aperture and an open position spaced from said discharge aperture, and (3) a manually releasable latch defined cooperatively by said base and lid to hold said lid closed; and a tamper-indicating element that is separate from, but mounted solely to, said lid to prevent manual release of said latch, said element being free of any attachment directly to said base, said element including a removable part and including an attachment structure that is engaged with said lid and that has a frangible portion which can be broken when sufficient force is applied to remove said removable part of said element from said lid to permit operation of said latch whereby the remaining part of said attachment structure remains on said lid to provide evidence that said removable part of said element has been removed.

2. The closure in accordance with claim 1 in which said tamper-indicating element includes a tang protruding into a region adjacent said latch to prevent operation of said latch.

3. The closure in accordance with claim 2 in which said tang includes a slanted first member, a lower, vertical member depending from said first member, and a rib projecting forwardly from said first member.

4. The closure in accordance with claim 3 in which said rib is narrower than said first and second members.

5. The closure in accordance with claim 1 in which said latch includes a lever projecting from said base and a receiving aperture in said lid through which said lever projects when said lid is closed for engaging an adjacent part of the lid; and said tamper-indicating element includes a tang projecting downwardly behind said lever to inhibit movement of said lever in a direction that would permit the lid to be opened.

6. The closure in accordance with claim i in which said tamper-indicating element includes a shroud projecting over a portion of said latch to prevent operation of said latch.

7. The closure in accordance with claim 6 in which said latch includes a lever projecting from said base and a receiving aperture in said lid through which said lever projects when said lid is closed for engaging an adjacent part of said lid; and said tamper-indicating element includes a shroud projecting over a portion of said lever to prevent operation of said lever.

8. The closure in accordance with claim 1 in which said closure further includes a hinge connecting said lid to said base.

9. The closure in accordance with claim 1 in which said element attachment structure includes three posts; and said lid defines three holes for each receiving one of said posts.

10. The closure in accordance with claim 1 in which said attachment structure includes (1) an anchor portion comprising (a) a triangular plate attached at each of three corners with a frangible portion to said removable part and (b) a post extending from said triangular plate and engaged with said lid; and (2) a frangible portion attaching each corner of said triangle plate to said removable part of said element.

11. The closure in accordance with claim 1 in which said lid defines a bore;

said element defines a hole, a flange projecting from the periphery of said hole, and three ribs extending radially inwardly from said hole;

said attachment structure includes a post connected to each said rib with said frangible portion, said post being received in said bore, said post having an enlarged head preventing removal of said post from said lid bore; and said post defines an anchor portion retained on said lid before and after said frangible portion is broken.

12. The closure in accordance with claim 1 in which said element includes a lift tab.

13. The closure in accordance with claim 1 in which said element defines a hole and a partially cylindrical flange around said hole; and said attachment structure includes a triangular plate connected with a frangible portion at each corner to said flange.

14. A tamper-evident closure for an opening to a container interior, said closure comprising:

a base for attachment to said container around said opening, said base having a deck defining a discharge aperture for communicating with said opening and having a resilient locking lever projecting from said deck;

a lid defining a latch aperture and an adjacent latch surface for engaging said lever;

a hinge for connecting said lid to said base in (1) a closed position wherein flow of the container-stored contents through the closure is occluded and wherein said locking lever projects through said latch aperture to engage and hold said lid in said closed position and (2) an open position moved away from said closed position permitting the dispensing of the container-stored contents from said discharge aperture; and a tamper-indicating element that is separate from, but mounted solely to, said lid to prevent manual release of said lever and latch surface, said element being free of any attachment directly to said base, said element including a removable part and including an attachment structure that is engaged with said lid and that has a frangible portion which can be broken when sufficient force is applied to remove said removable part of said element from said lid to permit operation of said lever to effect disengagement from said latch surface whereby the remaining part of said attachment structure remains on said lid to provide evidence that said removable part of said element has been removed.

15. The closure in accordance with claim 14 in which said attachment structure includes a post projecting from a triangular plate having semi-cylindrical corners.

16. The closure in accordance with claim 14 in which said attachment structure includes a post and includes three frangible portions connecting said post to said removable part of said tamper-indicating element.

17. The closure in accordance with claim 14 in which said tamper-indicating element removable part includes a plate-like portion defining three holes; and said attachment structure includes three anchor portions each connected to said removable part of said tamper-indicating element at three locations around the periphery of one of said holes.

18. The closure in accordance with claim 14 in which said attachment structure includes a post located on one side of said removable part of said tamper-indicating element.

19. The closure in accordance with claim 14 in which said tamper-indicating element includes a latch guard angled from said removable part of said tamper-indicating element adjacent said lever.

* * * * *